US006299517B1

(12) United States Patent
Weber

(10) Patent No.: US 6,299,517 B1
(45) Date of Patent: Oct. 9, 2001

(54) BELT SANDING MACHINE

(76) Inventor: Georg Weber, Friesener Strasse 27, 96317 Kronach (DE)

( * ) Notice: Subject to any disclaimer, the term of this patent is extended or adjusted under 35 U.S.C. 154(b) by 0 days.

(21) Appl. No.: 09/533,916

(22) Filed: Mar. 23, 2000

(30) Foreign Application Priority Data

Feb. 28, 2000 (DE) ..... 200 03 656

(51) Int. Cl.[7] ..... B24B 21/00

(52) U.S. Cl. ..... 451/309; 451/296; 451/299; 451/300; 451/303

(58) Field of Search ..... 451/296, 299, 451/300, 303, 309

(56) References Cited

U.S. PATENT DOCUMENTS 3,408,775 * 11/1968 Rutt ..... 451/309
4,839,994 * 6/1989 Heesemann ..... 451/6
6,001,004 * 12/1999 Bottehi ..... 451/168

* cited by examiner

*Primary Examiner*—Timothy V. Eley
*Assistant Examiner*—Shantese McDonald
(74) *Attorney, Agent, or Firm*—McCormick, Paulding & Huber, LLP

(57) ABSTRACT

In a band grinding machine, especially well adapted for grinding wooden frames having transverse and longitudinal wooden pieces, a support table in the form of an endless belt transports the frames in an advancement direction, a transverse grinding assembly with a transversely moving grinding band extending over the width of the support table grinds the entire tops of frames, and two longitudinal grinding assemblies, located behind the transverse grinding assembly in the advancement direction, respectively grind the two longitudinal wooden pieces of each frame, with each longitudinal grinding assembly having a longitudinally moving grinding band with a width very small in comparison to the width of the table, and with at least one of the longitudinal grinding assemblies being adjustable transversely of the advancement direction to allow the spacing of the longitudinal grinding assemblies to be set to match the spacing of the longitudinal frame pieces.

2 Claims, 1 Drawing Sheet

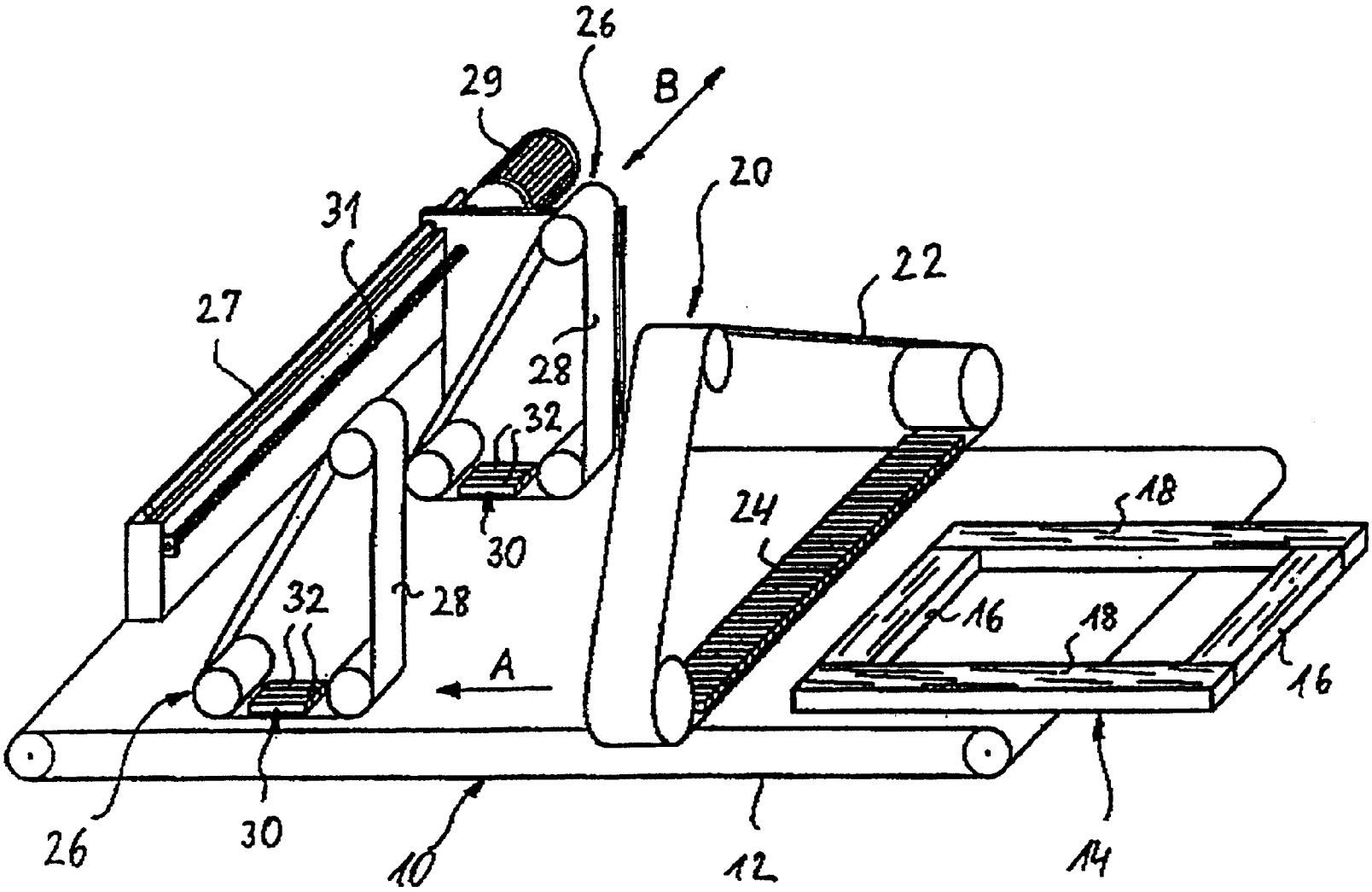
16
18
18
14
16
22
24
12
20
B
26
28
32
30
29
A
28
10
31
32
30
27
26

BELT SANDING MACHINE

FIELD OF THE INVENTION

The invention concerns a band grinding machine, including a work piece support table with self-actuating work piece advancement and grinding assemblies following one another in the advancement direction of the work pieces and with different band movement directions.

BACKGROUND OF THE INVENTION

The grinding of wooden frames causes problems since the grain fiber directions of the longitudinal and transverse wooden parts of the frame are different, and it is desirable that the upper surface of a frame wooden part not be ground transversely to its fiber direction.

To avoid this disadvantage, band grinding machines are already known in which for a cross-grinding, a transverse band assembly and a broad band assembly are arranged behind one another in the advancement direction. The transverse band first grinds the top of the entire frame. The broad band assembly has two pressure shoes or pressure bars arranged parallel to the advancement direction which are adjustable transversely to the advancement direction so that the broad band can targetly be pressed against the longitudinal wooden parts of the frames to be ground. Therefore, the grinding tracks produced on the wooden longitudinal parts by the transverse band can be removed. A disadvantage of this solution is, however, that the grinding band of the broad band assembly is worn only locally.

In a further known cross-grind grinding machine, the broad band by means of an electronically controlled multiple member pressure bar is pushed downwardly in areas corresponding to the longitudinal wooden pieces. Also in this case, there arises the disadvantage that the broad band is only locally worn. Moreover, problems arise in the adjustment of the grinding width to the actual longitudinal wooden piece width, since the individual pressure elements of the pressure bar cannot be made as small as desired and, therefore, the danger exists that the longitudinal wood pieces are either not ground up to their longitudinal edges or that the longitudinal edges are ground round.

The invention has as its object the provision of a band grinding machine of the aforementioned kind which permits a desired grinding of the work piece parts parallel to their grain fiber directions with optimal utilization of the used grinding means.

BRIEF DESCRIPTION OF THE INVENTION

For the solution of the above object, a band grinding machine in accordance with the invention has a transverse band assembly with a grinding band running transversely to the work piece advance direction, which band extends over the entire width of the work piece support table, and, following the transverse band assembly in the advance direction, at least two longitudinal band assemblies the grinding band of each of which runs parallel to the work piece advance direction and has a width which is small in comparison to the width of the work piece support table, with the position of at least one of the longitudinal band assemblies being adjustable transversely to the work piece advance direction.

In the grinding of frames with a band grinding machine of the invention, as previously the entire frame is preferably first ground over its top with the transverse band. Subsequently, with the help of the longitudinal band assemblies, only the longitudinal wood pieces are ground. The longitudinal band assemblies can, for this purpose, be adjusted exactly to the positions of the longitudinal wood pieces. There exists also the possibility that the frames, for example, on one of their sides run along a stop and that the longitudinal band assembly associated with the longitudinal wood piece near the stop is stationary, with only the one longitudinal band assembly associated with the other longitudinal wood piece being adjustable.

Since the grinding bands of the longitudinal band assemblies have a width suited to the width of the longitudinal wood pieces to be ground, the supplied grinding means is optimally utilized, which in view of the substantial costs for grinding bands represents a substantial cost advantage. Moreover, the area in which each of the longitudinal grinding bands is effective on the longitudinal wooden pieces can be more exactly adjusted than with a wide band with help of its multiple-part pressure bar in its unchangeable position.

The grinding results can be further optimized if each of the longitudinal band assemblies has a segmented grinding bar whose segments are individually controllable. Thereby, a bend and unevenness of the work piece can also be smoothed out.

BRIEF DESCRIPTION OF THE DRAWING

The following description explains, in combination with the accompanying drawing, the invention by way of an exemplary embodiment. The single FIGURE of the drawing shows the essential elements of a band grinding machine embodying the invention in a schematic representation.

DETAILED DESCRIPTION OF PREFERRED EMBODIMENT

In the drawing is seen a work piece supporting table 10 with an endless transport band 12 which so runs that it transports a work piece 14, for example a wooden frame, in the direction of the arrow A through the band grinding machine. The frame 14 consists of transverse wooden pieces 16 with grain fibers running perpendicular to the advancement direction A and longitudinal wooden pieces 18 with grain fibers running parallel to the advancement direction.

Above the work piece support table 10 is a transverse band assembly, whose grinding band 22 runs transversely to the advancement direction A and which extends over the entire working width of the work piece supporting table. The transverse band assembly 20 has, in a way known in itself, a multiple part pressure bar 24 through the control of which the grinding band 22 can be so pressed onto the surfaces to be ground as to avoid, for example, grinding round the edges of the work pieces.

Behind the transverse band assembly 20 in the advancement direction A are two longitudinal band assemblies 26. One of these grinding assemblies 28 is adjustable on a guide 27 fixed to the machine frame, by means of a spindle 31 driven by a motor 29, transversely to the advancement direction A in the direction of the double arrows B, so that the spacing between the oppositely positioned grinding assemblies 28 can be adjusted to exactly the positions of the longitudinal wood pieces 18 of the frames 14 to be ground. Also, both of the grinding assemblies 28 can be adjustable in the previously mentioned way. The width of the grinding bands 28 running parallel to the advancement direction of the longitudinal band assemblies 26 is so chosen that they are only slightly wider than the width of the longitudinal wooden parts 18 to be ground. The longitudinal band assemblies 26 each have segmented pressure bars 20 whose individual elements 32 can be individually controlled in order to targetly push the grinding band 28 onto the longitudinal wooden parts to be ground in such way as to optimize the grinding results.

With the band grinding machine of the invention, the tops of the frames 14 to be ground are first preferably ground once and entirely by the transverse band 22. The grinding tracks which run perpendicularly to the grain fibers on the longitudinal wooden parts 18 are then subsequently removed by the grinding bands 28 of the longitudinal band assemblies 26.

What is claimed is:

1. A band grinding machine comprising:

a work piece support table (10) with self-acting work piece advancement, and grinding assemblies (20, 26) following one another in the advancement direction (A) of the work pieces (14) with different band movement directions, one of said grinding assemblies being a transverse band assembly (20) with a grinding band (22) running transversely to the work piece advancement direction (A) and which extends over the entire width of the work piece support table (10), and said grinding assemblies further including at least two longitudinal band assemblies (26) following said transverse band assembly (20) in the advancement direction (A), each of which longitudinal band assemblies (26) has a grinding band (26) running parallel to the work piece advancement direction (A) and a width which is small in comparison to the width of the work piece support table (10), the position of at least one of said longitudinal band assemblies (26) being adjustable transversely of the work piece advancement direction (A).

2. A band grinding machine according to claim 1, wherein:

each of the longitudinal band assemblies (26) has a segmented grinding bar (30) with individually controllable segments (32).

* * * * *